US005730053A

United States Patent [19]

Tenflede et al.

[11] Patent Number: 5,730,053

[45] Date of Patent: Mar. 24, 1998

[54] BUS SYSTEM FOR A PRINTING MACHINE

[75] Inventors: Johannes Tenflede, Rodgau; Michael Dotzert, Friedrichsdorf; Gerold Wende, Frankfurt am Main, all of Germany

[73] Assignee: MAN Roland Druckmaschinen AG, Germany

[21] Appl. No.: 607,262

[22] Filed: Feb. 21, 1996

[30] Foreign Application Priority Data

Feb. 23, 1995 [DE] Germany ..... 195 06 261.2

[51] Int. Cl.[6] ..... B41F 5/06

[52] U.S. Cl. ..... 101/181

[58] Field of Search ..... 101/181, 248

[56] References Cited

U.S. PATENT DOCUMENTS 5,101,474 3/1992 Schlegel et al. ..... 395/114

FOREIGN PATENT DOCUMENTS 0 543 281 A1 11/1992 European Pat. Off. ..... 101/181
42 12 742 A1 10/1993 Germany ..... 101/181
44 37 417 A1 4/1995 Germany ..... 101/181

OTHER PUBLICATIONS

*Der Polygraph*, 9-86, pp. 1103-1104, "Glasfasertechnik findet nun auch Eingang in den Druckmaschinenbau," (w/English translation).

*Primary Examiner*—Edgar S. Burr
*Assistant Examiner*—Steven S. Kelley
*Attorney, Agent, or Firm*—Leydig, Voit & Mayer, Ltd.

[57] ABSTRACT

A bus system for a printing machine, in particular a sheet-fed offset printing machine, which includes a plurality of stations designed as computers, which are connected to one another via a bus. In the bus, it is intended that potential errors which occur at unforeseeable times can be detected, without it being necessary to intervene in the line system of the bus. According to the invention, this is achieved in that at least one of the stations has a bus coupler whose transmitting portion is designed for the purpose of outputting bus signals for the purpose of establishing a connection to the other stations, the value of at least one physical variable differing from the value of this variable provided in the line protocol. In the case of a bus designed as an optical waveguide, this is advantageously achieved by one station carrying out the attempt to establish a connection initially at a low transmitted power.

2 Claims, 3 Drawing Sheets

BUS SYSTEM FOR A PRINTING MACHINE

BACKGROUND OF THE INVENTION

1. Field of the Invention

The present invention relates to a bus system for a printing machine, and more particularly, to a bus system wherein an evaluation of the connections made via the bus system may be made prior to operation.

2. Discussion of the Related Art

In the case of sheet-fed offset printing machines, as has long been the case in large web-fed rotary printing machines, it is known to arrange stations in the form of computers in the individual units and to connect the stations to one another by means of a bus. For example, EP 0 543 281 A1 discloses a controller for rotary printing machines in which each part of the plant has one or more computer units assigned to it and these units are connected to one another via a coax or twisted two-wire line bus. It is thus possible to send commands in the form of bus signals to the individual computer units in the respective sets of machines, for example, from a master station via which the entire control of the printing machine is carried out. The individual units which are connected, for example, to sensors or other detection devices, can likewise send back signals to the master station. Similarly, provision can be made for the computer units to transmit and receive information in the form of signals autonomously and with equal rights, i.e., no set master computer unit.

The German Zeitschrift der Polygraph, Sep. 1986, page 1103 and 1104 discloses connecting the microprocessors arranged in the individual printing units to each other and to the remote control desk of the printing machine via a compound network made of glass fiber cables, i.e., fiber-optic cables. The advantage of glass fiber technology as used in bus systems lies in the fact that it provides for the greatest possible data transfer rate with complete immunity against electrical and magnetic disturbances.

A disadvantage associated with both electrical and optical buses is the actual physical connection of the bus to the computer station. For example, in the case of installation work, and in particular in the case of service work, the connections of the individual stations to the bus may have to be made, detached and remade a number of times. Because of the number of reconnections that may be required, there is the potential that the electrical and/or optical connections, for example, plug and socket connections, are made in an improper manner. In the case of electrical plug and socket connections, for example, incomplete plugging in or the introduction of contaminants into the plug and socket connector can lead to the station, which is connected to the bus in this manner, to experience an improper signal coupling to the bus. In this case, proper signal transfer can still take place between the bus and the respective station for a specific time, but there is a potential error source which can lead to unforeseeable sudden failures even after normal operation and after the performance of known bus tests by means of signal routines and the like.

In the case of installation work and service work, the lines comprising the bus system are often loaded in a manner which does not accord with the regulations. Thus, it can occur that the cable of an optical waveguide or of a coax line is curved or kinked too severely. Also, as a result of the pulling of cables, in particular through narrow, sharp-edged openings, damage to the insulation or protective sheathings can occur. Twisted two-wire line buses are also exposed to the possibilities of damage of this type.

The possibilities for damage through faulty handling, as described above, likewise represent a potential error source. As described above, this potential error source can also lead to unforeseeable sudden failures even after normal operation and testing.

Apart from improper handling of the bus system, particularly in the case of coax or twisted two-wire line buses, it is also possible for disturbances, such as interfering fields, i.e., electromagnetic interference, to lead to a reduction of the transmission capacity, if not to the total transmission failure of the respective bus system. Examples of disturbances of this nature include magnetic or capacitive coupling of heavy current lines, mutual coupling of adjacent lines and currents in screening lines. Disturbances of this type also represent a severe impairment of the bus system, which occurs, in particular if lines, e.g., service lines, are not properly laid out and are too closely spaced apart from neighboring systems employing transmission lines or the like. Ageing of components, in particular in the case of optoelectronic signal transmission, also represents a potential error source.

In the case of glass fiber cables and optical waveguides, it is known to detect their functional integrity with respect to signal transmission via the measurement of the optical attenuation. However, for this purpose it is necessary to detach the joined ends in the line from the respective station and to connect them to a special measuring and diagnostic device. In the case of the subsequent connection of the joined ends of a line to the units, this can likewise lead to potential error sources because of the necessary handling, in particular if the optical coupling between line ends and the associated optoelectronics is not properly made. If, in this case, the optoelectronics of a station has a plurality of inputs and even free inputs, erroneous coupling is furthermore also possible during the reestablishing of the optical waveguide connection.

SUMMARY OF THE INVENTION

In accordance with one aspect, the present invention is directed to a bus system for a printing machine having a plurality of stations. The bus system comprising a bus for data exchange between the plurality of stations, a plurality of bus couplers coupling the plurality of stations to the bus, each of the plurality of bus couplers comprising a transmitting portion and a receiving portion, and a control and evaluation unit connected to at least one of the plurality of bus couplers. The control and evaluation unit configuring the transmitting portion of the at least one bus coupler to transmit signals having at least one physical variable value different from a value of the physical variable provided in a bus protocol of the bus to one or more of the stations via the bus in order to establish a connection with one or more of the stations.

The term bus or bus system is also used here for transmission lines in which a data transmission is carried out in each case between adjacent stations in the manner of a loop.

According to the present invention, provision is made for at least one of the stations coupled to the bus system to have a bus coupler which, from time to time, or each time the bus system is switched on (power-on), transmits a signal sequence onto the bus system for the purpose of setting up a connection to the other station or stations, this signal output being carried out via the bus coupler in such a manner that at least one physical variable of the line protocol on which the bus system is based lies outside a provided range. This can be carried out, in particular in the case of optical waveguides, in such a manner that, for example, a master station, at the time of a power-on, that is to say when the printing machine and controller are switched on, attempts to set up a connection to the other stations via the bus system at a low transmitted power. In this case provision may be made for one station to repeat this connection pick-up with successively increasing transmitted power. Only when all the stations addressed acknowledge the setting up of the connection properly does the bus coupler of the station provided switch over to the provided transmitted power and normal transmitting operation is carried out in the error-free case. The acknowledgement is carried out in an expedient way at the transmitted power level provided in accordance with the line protocol. By means of the successive increasing of the transmitted power during the attempt to set up connections to the other addressed stations, it is possible to determine what minimum transmitted power the bus line needs to make a proper data transmission. It is thus possible to form the difference between the normal transmitted power according to line protocol and the minimum transmitted power determined in this way, from which a measure for the system reserve can be derived.

An error source which has occurred as described above will, however, as a rule have the effect that the difference between the normally provided transmitted power and the minimum transmitted power which has just been required to set up a connection becomes distinctly smaller. As a result of the bus coupler which is configured in accordance with the invention, this can be determined and can be used, for example, to display a corresponding warning indication or even for triggering a system abort with a blocking of the printing machine drive against start-up.

The principle according to the present invention is in this case not restricted only to use in bus systems which have glass fiber cables or optical waveguides. It is also not necessary to vary the transmitted power with which one station attempts to set up the connection to other stations, rather it is possible to use other physical variables in a way deviating from the line protocol. According to the present invention, potential bus error sources can also be determined by carrying out the establishment of the connection with a deviating transmitted frequency, with a bandwidth which is different from that provided, with the deliberate intermixing of side frequencies or disturbing frequencies and the like. Here, too, the criterion for determining the system reserve is the varying of a physical transmitted variable, that is to say at which value the value of the varied physical variable results in a proper establishment of a connection between the stations.

If the transmission lines of the bus system are designed as a so-called loop, in which the data are forwarded from one station to an adjacent station, each station thus has a bus coupler according to the present invention. The transmission lines between adjacent stations are then tested.

In the case of a transmission line which is constructed as a bus in the correct sense, it is sufficient for only one station to have a correspondingly controllable bus coupler for the variation of at least one physical transmitted variable.

BRIEF DESCRIPTION OF THE DRAWINGS

Exemplary embodiments of a bus system for a printing machine in accordance with the present invention is described below with reference to the accompanying drawings in which.

DETAILED DESCRIPTION OF THE PREFERRED EMBODIMENTS

Figure 1:
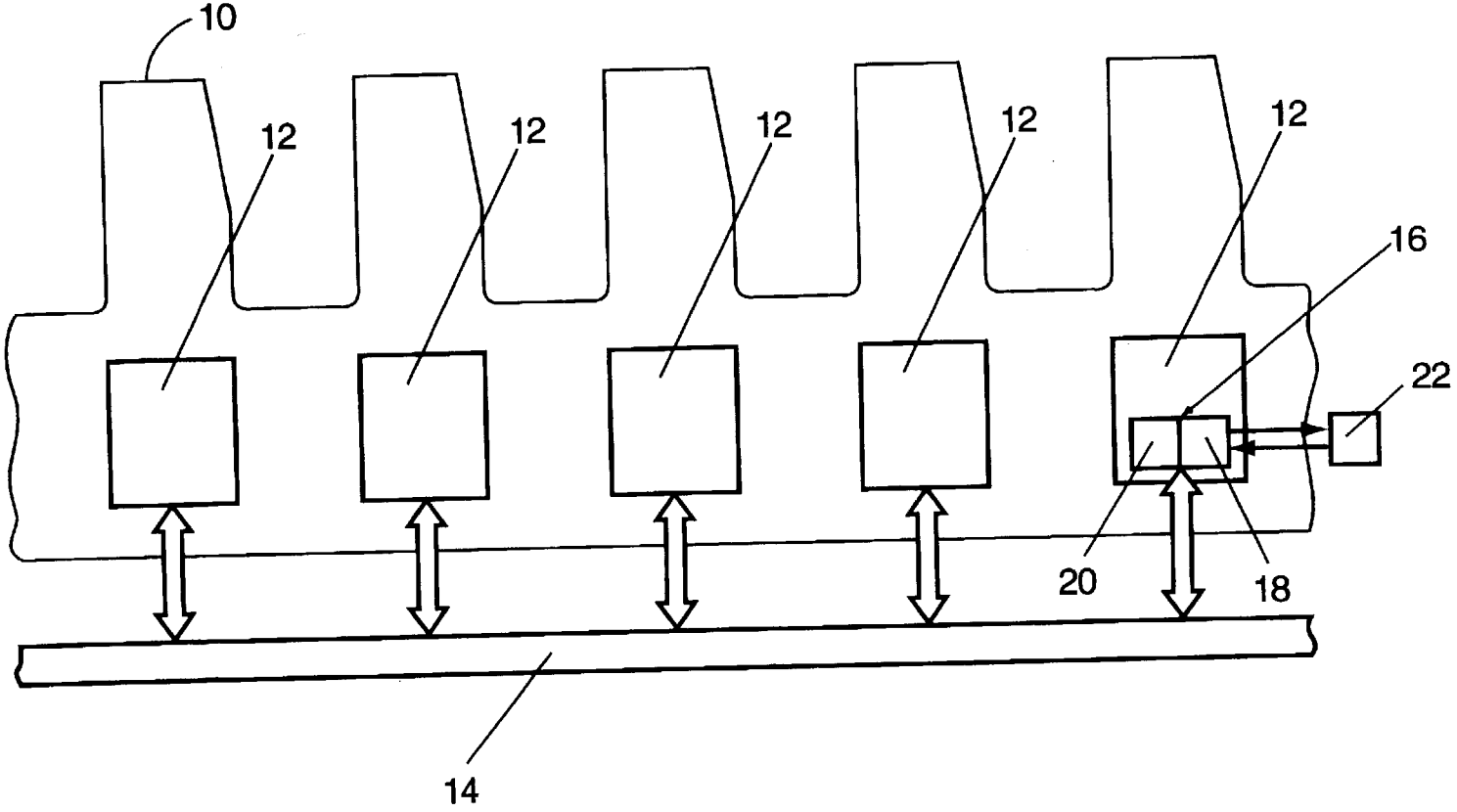
FIG. 1 is a diagrammatic representation of a bus system in accordance with the present invention.

FIG. 1 illustrates a plurality of printing units 10 of a sheet-fed offset printing machine. Associated with each of the individual printing units 10 is a station 12 which, in one exemplary embodiment, comprises a computer. The number of printing units 10 and associated stations 12 may vary depending on the size of the offset printing machine. The stations 12 may be different from one another, or identical to one another. The stations 12 may be coupled to one another and communicate with one another utilizing a wide variety of coupling configurations. In the illustrated embodiment, the stations 12 may be coupled and communicate utilizing a bus system having a bus 14. The bus 14 may comprise any structure suitable for two-way communication between the stations 12 coupled to the bus 14. In a preferred embodiment, the bus 14 comprises an optical waveguide.

Each of the stations 12 comprises a bus coupler 16 which links its respective station 12 to the bus 14. The bus coupler 16 includes a transmitting portion 18 and a receiving portion 20. The transmission and reception of signals, for example, representing data, commands, instructions or the like, between stations 12 is accomplished via the bus 14 and the bus couplers 16. Incoming signals from the bus 14 are processed through the receiving portion 20 of the bus coupler and outgoing signals from the station are processed through the transmitting portion 18 of the bus coupler 16.

The transmitting portion 18 of the bus coupler 16 of at least one of the stations 12 may be connected to a control and evaluation unit 22. The control and evaluation unit 22 may be utilized so that signals of differing signal power can be output on the bus 14 via the optoelectronics of the bus coupler 16. The transmitting portion 18 comprises a light transmitter which may be controlled by the control and evaluation unit 22 in order to modulate the power of the signal to be transmitted to the bus 14. Essentially, the control and evaluation unit 22 sets the power level of the signals from the transmitter portion 18 such that the signals may be accurately and efficiently carried on the optical waveguide bus 14.

Figure 4:
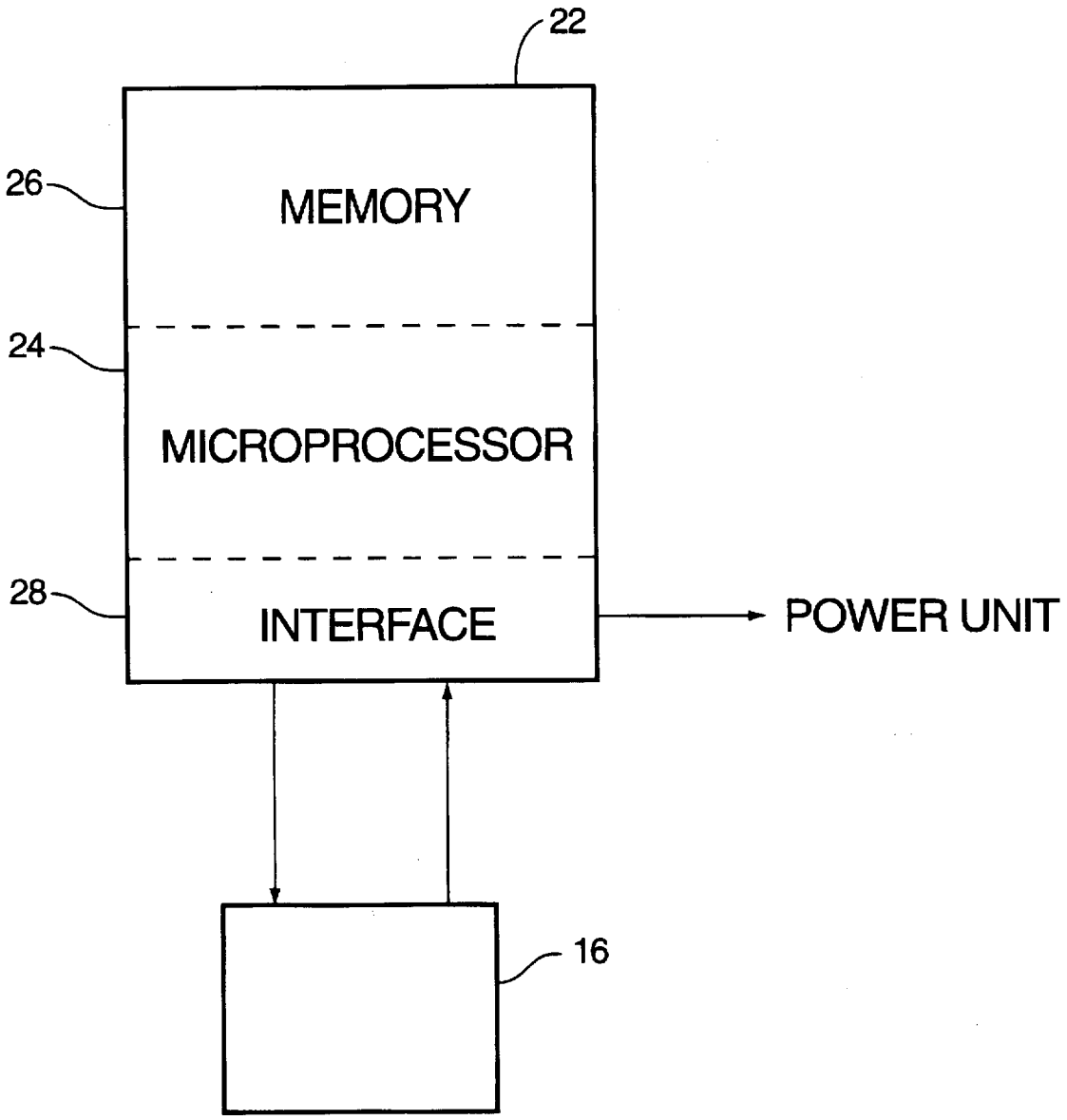
FIG. 4 is a block diagram of the control and evaluation unit of the bus system of the present invention.

The control and evaluation unit 22 may comprise any system suitable for the control and interrogation of the bus coupler 16, specifically the transmitting portion 18, to which it is attached. In a preferred embodiment the control and evaluation unit 22 comprises a microprocessor and associated memory. FIG. 4 is a block diagram representation of the control and evaluation unit 22. As illustrated, the control and evaluation unit 22 comprises the microprocessor 24, the associated memory 26, and interface circuitry 28. The control and evaluation unit 22 is connected to the transmitting portion 18 of the bus coupler 16 and a power supply of the printing machine through the interface circuitry 28.

The microprocessor 24 may comprise any suitable microprocessor having the computational speed and timing requirements for use in printing machines. The memory 26 may comprise any suitably sized memory for use with the present invention. For example, the memory 26 may comprise an EEPROM section for storing a control program. The interface circuitry 28 may comprise all the necessary circuitry for accurate and efficient communication between the bus coupler 16 and the microprocessor 25.

Under the control of the control and evaluation unit 22, the transmitting portion 18 of the bus coupler 16 outputs signals having differing physical variables in order to attempt connection with one or more of the other stations 12 via the bus 14. By utilizing differing physical variables, it is possible to determine the minimum signal requirements for proper data transmission over the bus 14. The control and evaluation unit 22 is also connected to a power supply (not illustrated) of the printing machine. Accordingly, the control and evaluation unit 22 may prevent printing machine operation if proper data transmission over the bus cannot be achieved.

In accordance with an exemplary embodiment of the present invention, data signal evaluation may be performed periodically and/or at least each time the bus 14 is powered on. In one embodiment, the control and evaluation unit 22 commands the transmitting portion 18 of the bus coupler 16 to transmit a signal sequence onto the bus 14 for the purpose of establishing a connection to one or more of the stations 12 coupled to the bus 14. One or more of the stations 12 may be specifically addressed, in which case the signal sequence is transmitted to the addressed station or stations 12, or all of the stations 12 may be addressed, in which case the signal sequence is transmitted to all stations 12. The signal sequence is carried out by the transmitter portion 18 of the bus coupler 16 in such a manner that at least one physical variable of the line protocol on which the bus 14 is based lies outside a provided range for the bus 14. This evaluation of the bus 14 may be implemented in the case of optical waveguides by attempts to establish a connection to the other stations 12 at power levels below the normal range for the bus 14. For example, the transmitted signal sequence may start with a signal having a power level well below the normal power level range for the bus 14 and then progressively higher power level signals. When all of the stations addressed in the evaluation acknowledge the connection, the acknowledgement provided in accordance with bus 14 protocol, data transmission over the bus 14 is possible and the bus coupler 16 to which the control and evaluation unit 22 is coupled switches over to a normal transmission mode at the proper power level as determined in the evaluation. By successively increasing the transmitted power during the evaluation, i.e., the attempt to establish connections to the other stations 12, it is possible to determine what minimum transmitted power the bus 14 requires to make a proper connection for error-free data transmission. It is thus possible to determine the difference between the normal transmitted power according to bus protocol and the minimum transmitted power determined in this way, from which a measure for the system reserve can be derived.

Figure 2:
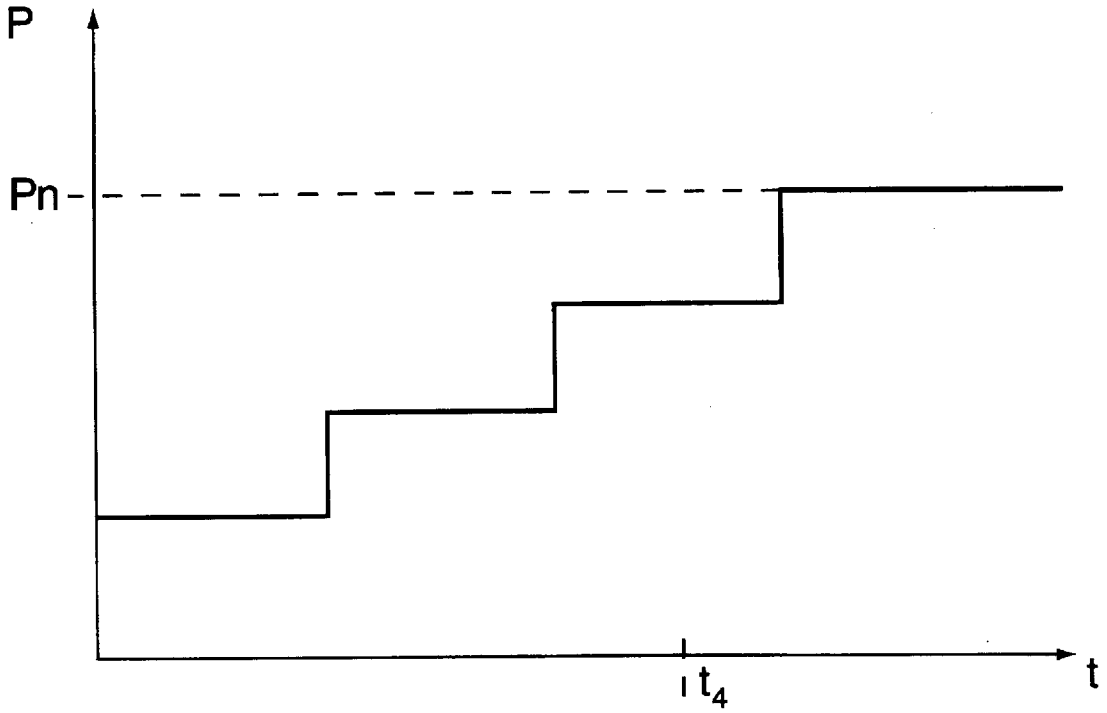
FIG. 2 is a graphical illustration of a signal sequence for evaluation of the bus system in accordance with the present invention.

FIG. 2 is a graph of power level versus time of an exemplary transmitted signal sequence output by the bus coupler 16 under the control and evaluation unit 22. As illustrated in FIG. 2, the transmission signal power increases in a stepwise manner from an initial level to a power level corresponding to the power level, $P_n$, required for data exchange on the bus 14. In the exemplary embodiment illustrated in FIG. 2, the bus coupler 16, via the transmitter portion 18, outputs three signal levels prior to outputting the power level required for data exchange. The bus 14, which in the exemplary embodiment comprises an optical waveguide, is a serial communication bus; therefore, the signal sequence is seen as a specific bit sequence. In this arrangement, the increasing of the transmitted power signals is accomplished in a stepwise fashion from signal output to signal output as far as the transmitted power value $P_n$ provided.

Figure 3:
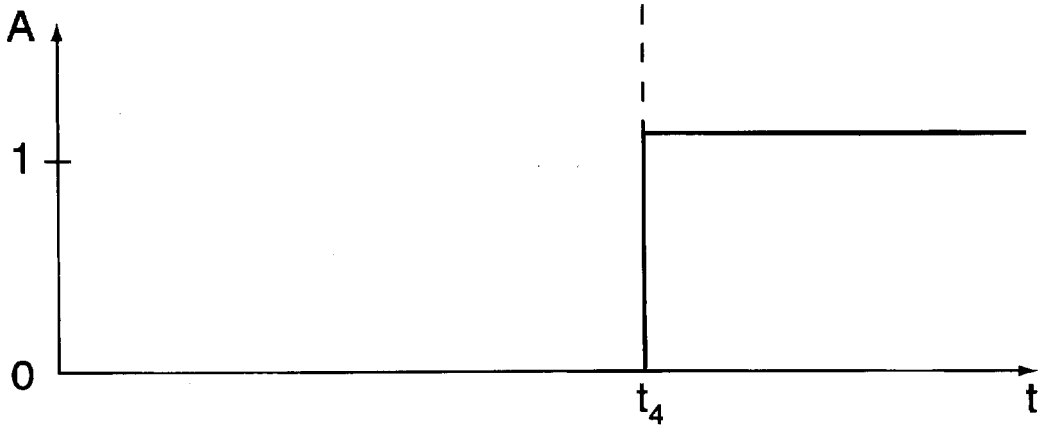
FIG. 3 is a graphical illustration of an acknowledgement signal sent in by response to the signal sequence.

FIG. 3 is a timing diagram illustrating the time at which one of the stations 12 addressed for connection to the transmitting station 12 from which the signal sequence originated, i.e., the station 12 connected to the control and evaluation unit 22. FIG. 3 illustrates that at time $t_1$ one of the stations 12 has detected the signal sequence for the purpose of establishing a connection over the bus 14 and has accordingly sent back the signal sequence to the transmitting station 12 at full transmitted power. The control and evaluation unit 22 generates a response signal A, which in the illustrated embodiment changes from a O to a 1 when the proper establishment of the connection between stations 12 via the bus 14 has been acknowledged by one or more of the stations 12. The stations 12 do not need to repeat transmission of the signals transmitted at reduced power to the transmitting station for the purpose of acknowledging the correct establishment of the connection, but rather, it is possible to carry out the acknowledgement of the correct establishment of the connection by means of a predetermined signal sequence or bit response. The control and evaluation unit 22 transmits the response signal A via the bus 14 at the transmitted power $P_n$.

Since the control and evaluation unit 22 has increased the power of the signals in the signal sequence in a stepwise manner, it is possible to determine by means of the control and evaluation unit 22, via the receiving portion 20 of the bus coupler 16 to which the control and evaluation unit 22 is coupled, how large the difference is between the normally provided transmitted power $P_n$ and the minimum necessary transmitted power for proper data traffic. It is thus possible to form from this power difference a quality value from which the size of the power reserve of the bus 14 can be determined. If this previously defined power difference falls below a predetermined limiting value, provision can be made for a warming indication to be displayed and/or the drive of the printing machine to be blocked against start-up, thereby avoiding potential errors.

The principle behind the present invention need not be restricted to buses comprising glass fiber cables or optical waveguides, for example, standard hard wire buses may be utilized. In addition, it is also not necessary to vary the transmitted power with which the station attempts to establish the connection to other stations, rather it is possible to use other physical variables in a way deviating from the bus protocol. In accordance with an alternative embodiment, potential bus error sources may also be determined by implementing the connections with a transmitted frequency which deviates from the protocol, with a bandwidth which is different from the protocol, with the deliberate intermixing of side frequencies or disturbing frequencies or the like. In this embodiment, the criterion for determining the system reserve is the varying of a physical transmitted variable, that is to say at which value the value of the varied physical variable results in a proper establishing of a connection between stations.

In the above exemplary embodiment, the invention was explained on the basis of an actual bus or bus system. Only one station 12 has the bus coupler 16 designed according to the invention. If the bus is designed as a loop, each of the stations present 12 has the bus coupler 16 according to the invention, so that in each case checking of the transmission lines between two adjacent stations is carried out. In this case, however, the previously described sequence is the same.

Although shown and described is what is believed to be the most practical and preferred embodiments, it is apparent that departures from specific methods and designs described and shown will suggest themselves to those skilled in the art and may be used without departing from the spirit and scope of the invention the present invention is not restricted to the particular constructions described and illustrated, but should be construed to cohere with all modifications that may fall within the scope of the appended claims.

What is claimed is:

1. A bus system for a printing machine having a plurality of stations, the bus system comprising: a bus comprising an optical waveguide having a protocol for data exchange between the plurality of stations; a plurality of bus couplers coupling the plurality of stations to the bus, each of the plurality of bus couplers comprising a transmitting portion and a receiving portion; and a control and evaluation unit connected to the bus coupler of at least one of the plurality of stations for configuring the transmitting portion of the bus coupler to transmit signals having stepwise changes to one or more of the other stations in order to establish a connection with one or more of the other stations, wherein (1) the signals include a value of a power level of an optical signal different from a value of the power level provided in the bus protocol of the bus and (2) at least one of the stepwise changes in the power level is below the normal range for the bus.

2. The bus system for a printing machine according to claim 1, wherein the plurality of stations are connected in a loop configuration via the bus, and the control and evaluation unit being connected to each of the plurality of bus couplers for configuring the transmitting portion of each of the bus couplers to transmit signals to one or more of the stations via the bus in order to establish a connection with one or more of the stations.

* * * * *